US005943648A

United States Patent [19]

Tel

[11] Patent Number: 5,943,648

[45] Date of Patent: Aug. 24, 1999

[54] SPEECH SIGNAL DISTRIBUTION SYSTEM PROVIDING SUPPLEMENTAL PARAMETER ASSOCIATED DATA

[75] Inventor: Michael P. Tel, Mountain View, Calif.

[73] Assignee: Lernout & Hauspie Speech Products N.V., Ieper, Belgium

[21] Appl. No.: 08/638,061

[22] Filed: Apr. 25, 1996

[51] Int. Cl.[6] ..... G10L 5/02

[52] U.S. Cl. ..... 704/260; 704/258

[58] Field of Search ..... 395/2.79, 2.85, 395/2.44

[56] References Cited

U.S. PATENT DOCUMENTS

| | | | |
|---|---|---|---|
| 4,913,539 | 4/1990 | Lewis | 352/87 |
| 5,111,409 | 5/1992 | Gasper et al. | 395/152 |
| 5,164,980 | 11/1992 | Bush et al. | 379/53 |
| 5,208,745 | 5/1993 | Quentin et al. | 364/188 |
| 5,231,492 | 7/1993 | Dangi et al. | 358/143 |
| 5,241,619 | 8/1993 | Schwartz et al. | 704/200 |
| 5,278,943 | 1/1994 | Gasper et al. | 395/2 |
| 5,347,306 | 9/1994 | Nitta | 348/15 |
| 5,357,596 | 10/1994 | Takebayashi et al. | 704/275 |
| 5,367,454 | 11/1994 | Kawamoto et al. | 364/419.2 |
| 5,577,165 | 11/1996 | Takebayashi et al. | 704/275 |
| 5,608,839 | 3/1997 | Chen | 395/2.44 |
| 5,613,056 | 3/1997 | Gasper et al. | 395/2.85 |
| 5,623,690 | 4/1997 | Palmer et al. | 395/806 |
| 5,630,017 | 5/1997 | Gasper et al. | 395/2.85 |
| 5,644,355 | 7/1997 | Koz et al. | 348/17 |
| 5,652,828 | 7/1997 | Silverman | 704/260 |
| 5,732,395 | 3/1998 | Silverman | 704/260 |
| 5,751,906 | 5/1998 | Silverman | 704/260 |
| 5,822,727 | 10/1998 | Garberg et al. | 701/243 |
| 5,832,435 | 11/1998 | Silverman | 704/260 |

OTHER PUBLICATIONS

Newton's Telecom Dictionary, p. 113, definition of audio signal, 1996.

Edmund X. Dejesus, "How the Internet Will Replace Broadcasting", Feb. 1996, BYTE, pp. 51–64.

*Primary Examiner*—David R. Hudspeth

*Assistant Examiner*—Michael N. Opsasnick

*Attorney, Agent, or Firm*—Bromberg & Sunstein LLP

[57] ABSTRACT

A speech signal distribution system includes a transmitting subsystem and one or more receiving subsystems. The transmitting subsystem has a text to speech converter for converting text into a data stream of formant parameters. A supplemental parameter generator inserts into the data stream supplemental data, including linguistic boundary data indicating which parameters in the stream of formant parameters are associated with predefined linguistic boundaries in the text. In one preferred embodiment, the boundary data indicates which formant parameters in the data stream are associated with sentence boundaries. In addition, the supplemental parameter generator optionally inserts the text, lip position data corresponding to phonemes in the text, and voice setting data into the data stream. The resulting data stream is compressed and transmitted to the receiving subsystems. The receiving subsystem receives the transmitted compressed data stream, decompresses the data stream to regenerate the full data stream, and splits off the supplemental data. The formant data is buffered until boundary data is received indicating that a full sentence, or other linguistic unit, has been received. Then the formant data is processed by an audio signal generator that converts the formant parameters into an audio speech signal in accordance with a vocal tract model. Voice settings in the supplemental data are passed to the audio signal generator, which modifies audio signal generation accordingly. Lip position data in the supplemental data may be processed by an animation program to generate animated pictures of a person speaking.

23 Claims, 4 Drawing Sheets

SPEECH SIGNAL DISTRIBUTION SYSTEM PROVIDING SUPPLEMENTAL PARAMETER ASSOCIATED DATA

The present invention relates generally to systems for transmitting voice messages in encoded form via a transmission media, and particularly to a system and method for converting text into an encoded voice message that includes both voice reproduction information as well as semantic and contextual information to enable a receiving system to produce audio signals in units of full sentences, to generate animated pictures of a person speaking simultaneously with the production of the corresponding audio signals, and to override voice settings selected by the transmitting system.

BACKGROUND OF THE INVENTION

There are many systems in use for transmitting voice messages from one place to another. While public and private telephone networks are the most common example, voice or audio messages are also transmitted via computer networks, including the Internet and the part of the Internet known as the World Wide Web. In a relatively small number of telephone systems, and in most computer contexts, voice messages are transmitted in a digital, compressed, encoded form. Most often, various forms of linear predictive coding (LPC) and adaptive LPC are used to compress voice signals from a raw data rate of 8 to 10 kilobytes per second to data rates in the range of 1 to 3 kilobytes per second. Voice quality is usually rather poor for voice signals compressed using LPC techniques down to data rates under 1.5 kilobytes per second.

Messages are also commonly transmitted via telephone and computer networks in text form. Text is enormously more efficient in its use of bandwidth than voice, at least in terms of the amount of data required to transmit a given amount of information. While text transmission (including the transmission of various binary document files) is fine for recipients who have the facilities and inclination to read the transmitted text, there are many contexts in which it is either essential or desirable for recipients to have information communicated to them orally. In such contexts, the transmission of text to the recipient is feasible only if the receiving system includes text to speech conversion apparatus or software.

Text to speech conversion is the process by which raw text, such as the words in a memorandum or other document or file, are converted into audio signals. There are a number of competing approaches for text to speech conversion. The text to speech conversion methodology used by the present invention is described in some detail in U.S. Pat. No. 4,979,216.

In addition to the efficient transmission of voice messages, the present invention addresses another problem associated with real time distribution of digitized voice messages via computer network connections. In particular, it is very common for data transmissions between a network server, such as World Wide Web (hereinafter Web) server and a client computer to experience periods during which the rate of transmission is highly variable, often including periods of one or more seconds in which the data rate is zero. This produces unsettling results when the receiving client computer is playing the received data stream as an audio signal in real time, because the result can be that speech stops and restarts mid-word or mid-phrase with silent periods of unpredictable length.

Yet another problem with existing speech message transmission systems is that there is very little the receiving system can do with the received message other than "play it" as an audio signal. That is, the receiving system generally cannot determine what is being said, cannot modify the voice characteristics of received signals except in very primitive ways (e.g, with a graphic band equalizer), and cannot perform any actions, such as generating a corresponding animation of a speaking person, that would require information about the words or phonemes being spoken.

It is therefore an object of the present invention to provide a speech signal distribution system that efficiently transmits data representing speech signals and that enables receiving systems a high degree of control over the use of that data.

It is another object of the present invention to use text to speech conversion to convert text into a data stream of parameters suitable for driving an audio signal generator that converts the stream of parameters into an audio speech signal in accordance with a vocal tract model, and for transmission of the data stream to receiving systems having such audio signal generators.

Another object of the present invention is to transmit a high quality speech signal to receiving systems using a bandwidth of less than 1.5 kilobytes per second.

Another object of the present invention is to transmit a speech signal to receiving systems with sentence boundary data embedded in the speech signal so as to enable the receiving systems to present audio speech signals as full, uninterrupted sentences, despite any interruptions in the transmission of said speech signal.

Yet another object of the present invention is to transmit a speech signal to receiving systems with lip position data embedded in the speech signal so as to enable the receiving systems to generate an animated mouth-like image that moves in accordance with the lip position data in the received data stream.

Still another object of the present invention is to transmit a speech signal to receiving systems with voice setting data (e.g., indicating special effects to be applied to the speech signal) embedded in the speech signal so as to enable the receiving systems to control the generation of audio speech signals in accordance with the voice setting data in the received data stream.

SUMMARY OF THE INVENTION

In summary, the present invention is a speech signal distribution system that includes a transmitting subsystem and one or more receiving subsystems. The transmitting subsystem has a text to speech converter for converting text into a data stream of formant parameters. A supplemental parameter generator inserts into the data stream supplemental data, including linguistic boundary data indicating which parameters in the stream of formant parameters are associated with predefined linguistic boundaries in the text. In one preferred embodiment, the boundary data indicates which formant parameters in the data stream are associated with sentence boundaries. In addition, the supplemental parameter generator optionally inserts the text, lip position data corresponding to phonemes in the text, and voice setting data into the data stream. The resulting data stream is compressed and transmitted to the receiving subsystems.

The receiving subsystem receives the transmitted compressed data stream, decompresses it to regenerate the full data stream, and splits off the supplemental data. The formant data is buffered until boundary data is received indicating that a full sentence, or other linguistic unit, has been received. Then the formant data received before the boundary data is processed by an audio signal generator that converts the formant parameters into an audio speech signal in accordance with a vocal tract model. Voice settings in the supplemental data are passed to the audio signal generator, which modifies audio signal generation accordingly.

Text in the supplemental data may be processed by a closed captioning program for simultaneously displaying text while the text is being spoken, or by a text translation program for translating the text being spoken into another language. Lip position data in the supplemental data may be processed by an animation program to generate animated pictures of a person speaking simultaneously with the production of the corresponding audio signals. The user of the receiving subsystem may optionally apply voice settings to the audio signal generator to either supplement or override the voice settings provided by the transmitting subsystem.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
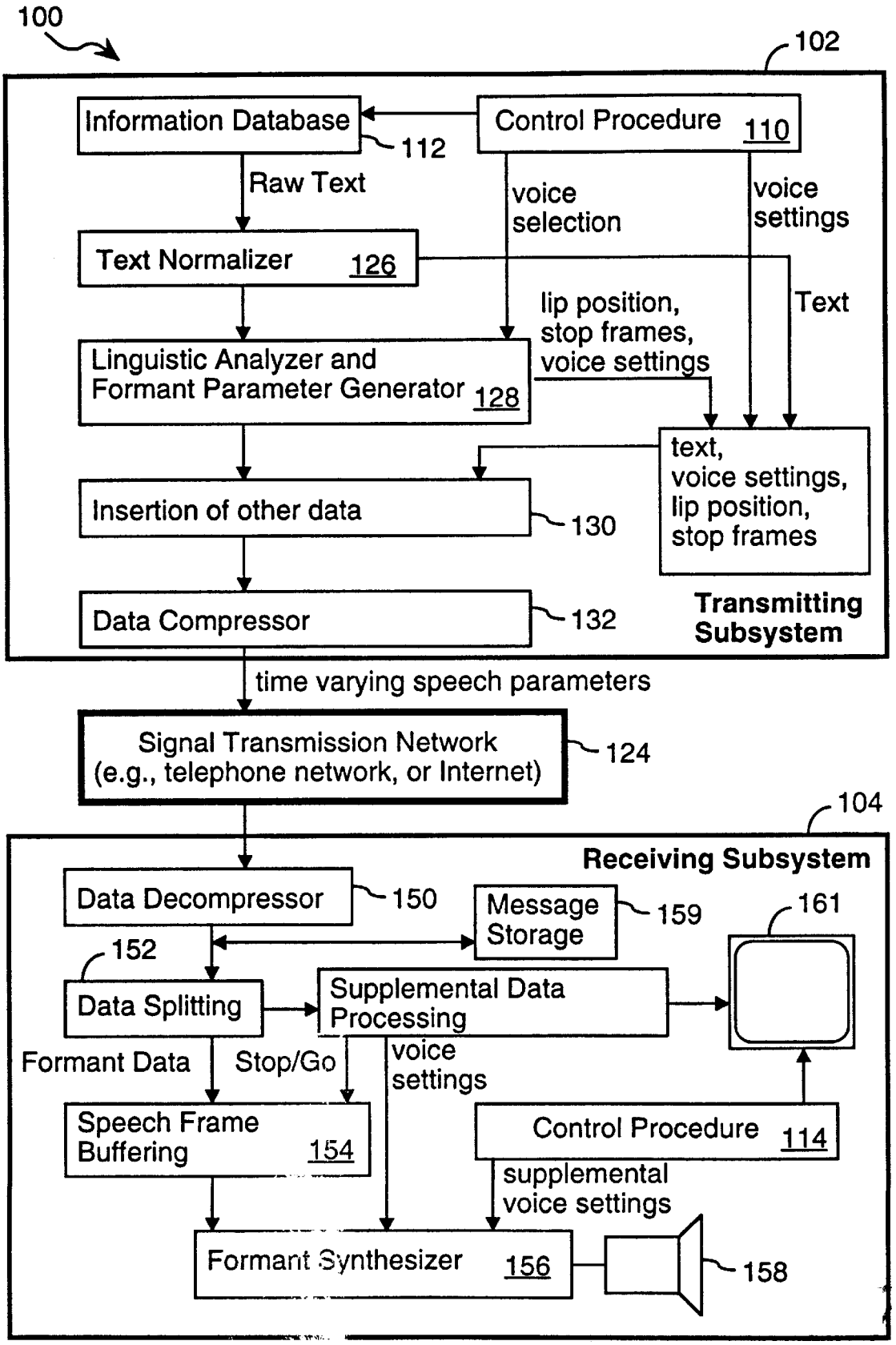
FIG. 1 is a block diagram of a speech signal distribution system in accordance with a preferred embodiment of the present invention.
Figure 2:
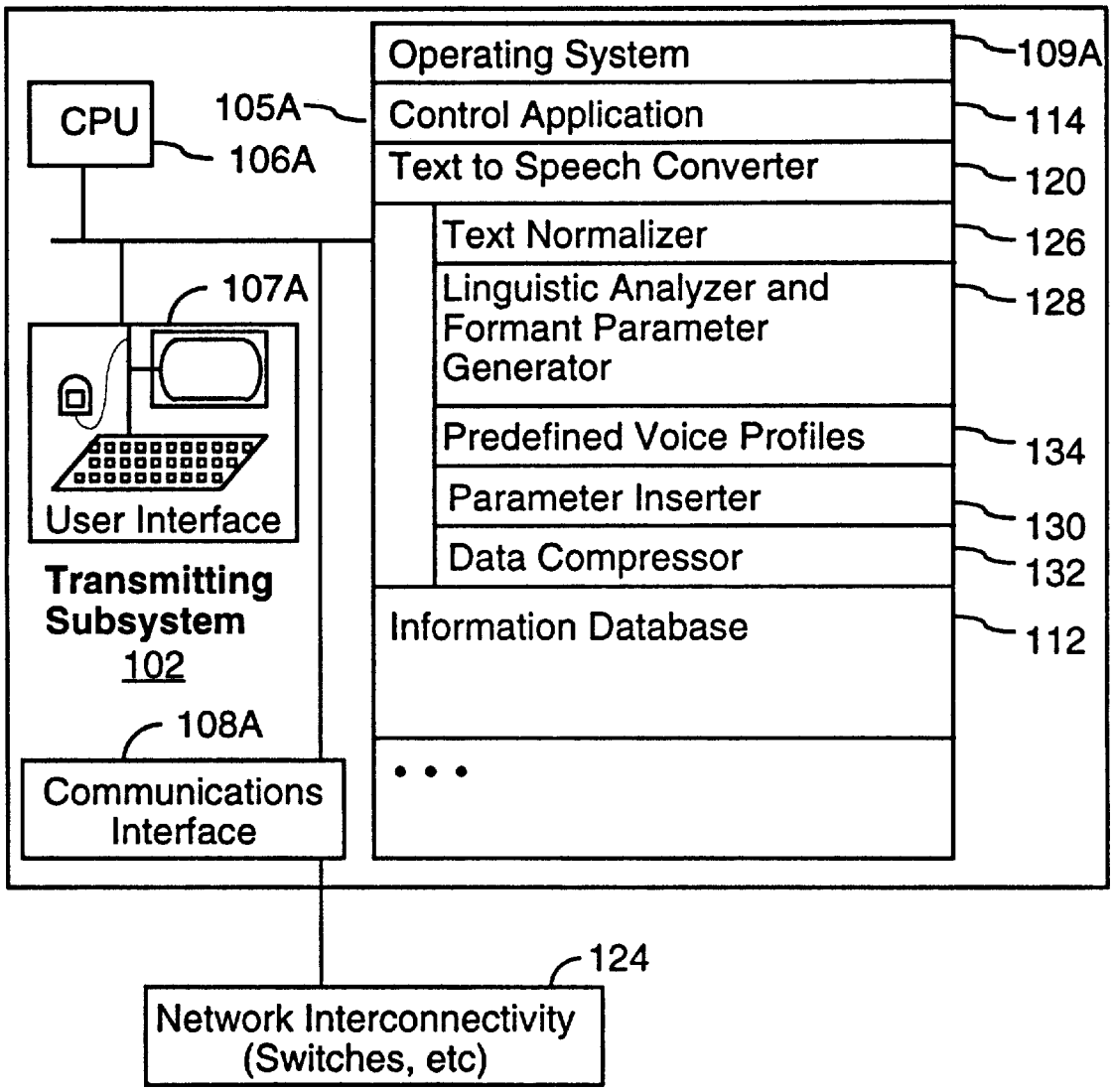
FIG. 2 is a block diagram of a computer system incorporating a transmitting subsystem in a speech signal distribution system.
Figure 3:
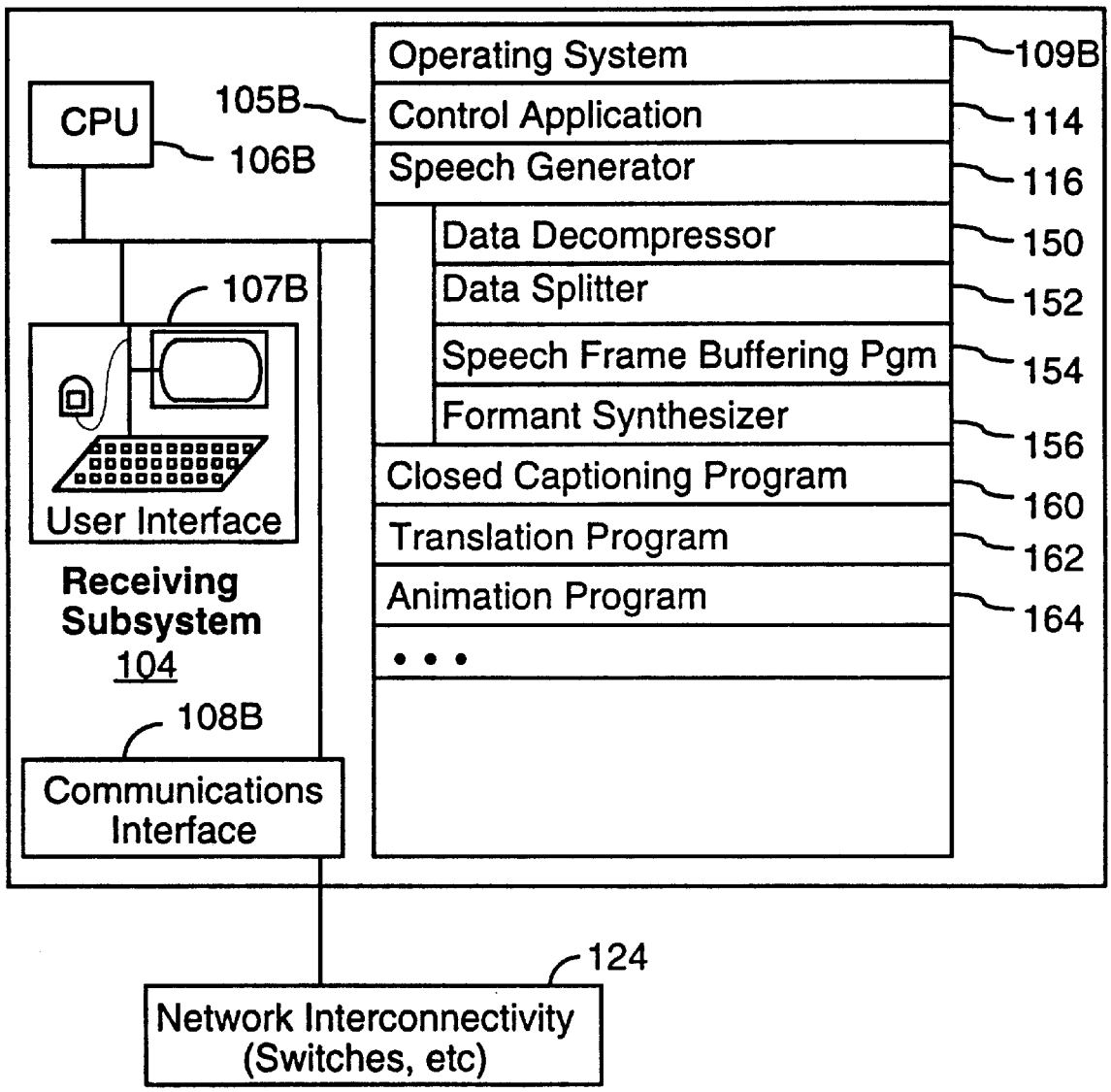
FIG. 3 is a block diagram of a computer system incorporating a receiving subsystem in a speech signal distribution system.

Referring to FIGS. 1, 2 and 3, there is shown a speech signal distribution system 100 having a transmitting subsystem 102 and many receiving subsystems 104, only one of which is shown in the Figures. Typically, the transmitter subsystem 102 is an information server, such as a (World Wide) Web server or interactive voice response (IVR) system that has a control application 110 that dispenses information from an information database 112 to end users using the receiving subsystems 104. The receiving subsystem 104 will also typically include a control application 114, such as Web browser or an IVR client application, that receives information from the information server and passes it to a speech generator 116 and other procedures.

The transmitting and receiving subsystems preferably each have memory (both RAM and nonvolatile memory) 105 for storing programs and data, a central processing unit (CPU) 106, a user interface 107, a communications interface 108 for exchanging data with other computers, and an operating system 109 that provides the basic environment in which other programs are executed.

In the transmitting subsystem 102, the control application 110 and the associated information database 112 output raw text in response to either a user's information request, or as part of some other information dispensing task (such as an "electronic mail" event or a scheduled information dispensing task). Raw text can also be received from other sources, such as another application program, or from the user via the transmitting subsystem's user interface 107A. A modified text-to-speech (TTS) converter 120 converts the raw text into a time varying parameter stream that is then transmitted via a communications interface 108A and then a communications network 124 (such as the telephone network, the Internet, or a private communications network) to one or more receiving subsystems 104.

In the preferred embodiment, the TTS converter 120 is a modified version of Centigram Communication Corporation's TruVoice product (TruVoice is a registered trademark of Centigram Communication Corporation). The text to speech conversion methodology used by the present invention is described in some detail in U.S. Pat. No. 4,979,216. In particular, the TruVoice product has been modified primarily to (A) insert additional information parameters not normally used during speech synthesis, and (B) perform data compression for more efficient speech signal transmission.

The "conventional" aspects of the TTS converter 120 include a text normalizer 126 and those aspects of a linguistic analyzer and formant parameter generator 128 that are directed to generating "formant data" for use by a formant synthesizer. The text normalizer 126 expands abbreviations, numbers, ordinals, dates and the like into full words. The linguistic analyzer and formant parameter generator 128 converts words into phonemes using word to phoneme rules supplemented by a look up dictionary, adds word level stress assignments, and assigns allophones to represent vowel sounds based on the neighboring phonemes to produce a phoneme string (including allophones) with stress assignments. Then that phoneme string is converted into formant parameters, in conjunction with the application of sentence level prosodics rules to determine the duration and fundamental frequency pattern of the words to be spoken (so as to give sentences a semblance of the rhythm and melody of a human speaker).

The non-conventional aspects of the TTS converter 120 include facilities for passing four types of parameters to a data insertion procedure 130:

- a subset of the words in the raw or modified text;
- voice settings, some of which are derived by the text normalizer 126, such as a voice setting to distinguish text in quotes from other text, and some of which are provided by the control application 110, such as instructions to raise or lower the pitch of all the speech generated;
- lip position data, which is derived by the modified linguistic analyzer from the phoneme string (i.e., a speaker's lip position is, in general, a function of the phoneme being spoken as well as the immediately preceding and following phonemes); and
- stop frame data, which indicates linguistic boundaries (such as sentence boundaries or phrase boundaries) in the speech.

It should be noted that while all four types of supplemental parameters can be inserted into the generated data stream, in many applications of the present invention only a subset of these parameters will be used. In alternate embodiments other types of supplemental data may be added to the format data stream.

In the preferred embodiment, a sentence boundary indication is always inserted into the data stream immediately after the last data frame of formant data for a sentence. In alternate embodiments, boundary data representing other linguistic boundaries, such as phrases or words could be inserted in the data stream. In a receiving system, the boundary data is used to control flow of speech production so as to avoid unnatural sounding pauses in the middle of words, phrases and sentences.

The text associated with the generated speech parameters is inserted in the data stream immediately prior to those speech parameters. The text data is useful for systems having a "closed captioning" program (i.e., for simultaneously displaying text while the text is being spoken), as well as receiving systems having features such as text translation programs 162 for translating the text being spoken into another language.

Lip position data is inserted in the generated data stream immediately prior to the speech data for the associated phonemes so as to allow receiving systems that have an animation program 164 to generate animated pictures of a person speaking simultaneously with the production of the corresponding audio signals. That is, the lip synchronization data allows video animation of a speaker that is synchronized with the generation of audio speech signals.

Voice settings are inserted in the generated data stream immediately prior to the first speech data to which those voice settings are applicable. Voice settings are usually changed relatively infrequently.

The general form of the data stream passed to the data compressor 132 consists of speech data frames interleaved with supplemental data frames. The speech data frames, also called formant data frames, includes "full frames" that include a full set of formant data as well as shorter frames, such as a special one-byte frame that represents one sample period of silence, and another one-byte frame that indicates a repeat of the previous formant data frame, as well as a short frame format for changing formant frequencies without changing fornant amplitude settings. The supplemental data frames include separate data frames for lip position data, text data, various voice settings, and linguistic boundary data.

The data compressor 132 compresses the data stream so as to reduce the bandwidth used by the data stream transmitted to the receiver subsystems. The resulting data stream generally uses a bandwidth of less than 1.5 kilobytes per second and in the preferred embodiment generates a data stream having a bandwidth of less than 1.0 kilobytes per second. Despite this very low bandwidth, the resulting speech generated by the receiving system is comparable to the quality of speech generated by adaptive LPC systems using data rates of approximately 2 to 3 kilobytes per second.

In some embodiments of the present invention, the linguistic analyzer and formant parameter generator 128 can include a plurality of predefined voice profiles 134, such as separate profiles for a man and a woman, or separate profiles for a set of specific individuals. In such systems the control procedure 110 indicates the voice profile to be used by providing a voice selection indication to the linguistic analyzer and formant parameter generator 128.

In some embodiments, such as Web server systems that always generate the same speech message whenever a particular Web page is accessed, the "information database" 112 may consist of a set of text files, rather than data in a database management system.

The compressed data stream generated by the data compressor 132 may be stored in a storage device, such as a magnetic disk, prior to sending it to one or more receiving subsystems. Such storage of compressed message data is needed if the transmitting subsystem works in a batch mode (e.g., storing messages over time and then sending all of them at a scheduled time), and may also be required for efficiency if the same message is to be transmitted multiple times to different receiving subsystems.

The receiving subsystem 104 includes the aforementioned communications interface 108 for sending requests to the transmitting subsystem 102 and for receiving the resulting data stream. The received data stream is routed to a speech generator 116, and in particular to a data decompressor 150 that decompresses the received data stream into the full data stream, and then a data splitter procedure 152 that splits off the supplemental data from the formant parameters. The formant data is buffered by a speech frame buffering program 154 until boundary data is received indicating that a full sentence, or other linguistic unit, has been received. Then the buffering program releases the formant data received prior to the boundary data for processing by an audio signal generator 156, also known as a formant synthesizer, that converts the formant data into an audio speech signal in accordance with a vocal tract model.

If the communication network 124 connecting the transmitting and receiving subsystems experiences periods during which the rate of transmission is variable, even periods of one or more seconds in which the data rate is zero, the buffering program 154 prevents the received speech data from being converted into an audio speech signal until all the data for a sentence or phrase has been received. This buffering of the speech data until the receipt of boundary data indicating a linguistic boundary avoids the generation of speech that stops and restarts mid-word or mid-phrase with silent periods of unpredictable length.

The voice settings in the supplemental data are passed to the audio signal generator 156, which modifies audio signal generation accordingly. The resulting audio speech signal is converted into audio sound energy by an audio speaker 158. The audio speaker 158 is typically driven by a sound card, and thus the audio speech signal generated by the audio signal generator 156 must typically be processed by a device driver program associated with the sound card, and then the sound card, before the audio speech signal is actually converted into audio sound energy by the audio speaker 158.

Text in the supplemental data may be processed by a closed captioning program 160 for simultaneously displaying text on a television of computer monitor 161 while the text is being "spoken," by the speech generator, or by a text translation program 162 for translating the text being spoken into another language. Lip position data in the supplemental data may be processed by an animation program 164 to generate animated pictures (on monitor 161) of a person speaking simultaneously with the production of the corresponding audio signals. In other words, the animation program 164 uses the lip position data to control the mouth position (and a portion of the facial expressions) of a person in an animated image.

The control program 114 of the receiving subsystem may optionally include instructions for enabling a user of the receiving subsystem to apply voice settings to the audio signal generator 156 to either supplement or override the voice settings provided by the transmitting subsystem.

The receiving subsystem 104 may further include storage 159 for storing one or more received messages, including both the speech parameters as well as the supplemental parameters of those messages. This allows the control application 114 to perform "tape recorder" functions such are replaying portions of a message. Since the message stored by the receiving subsystem has sentence boundary information embedded in the message, the control application 114 enables the user to "jump backward" and "jump forward" a whole sentence at a time, instead of a fixed number of seconds like a normal tape recorder.

Figure 4:
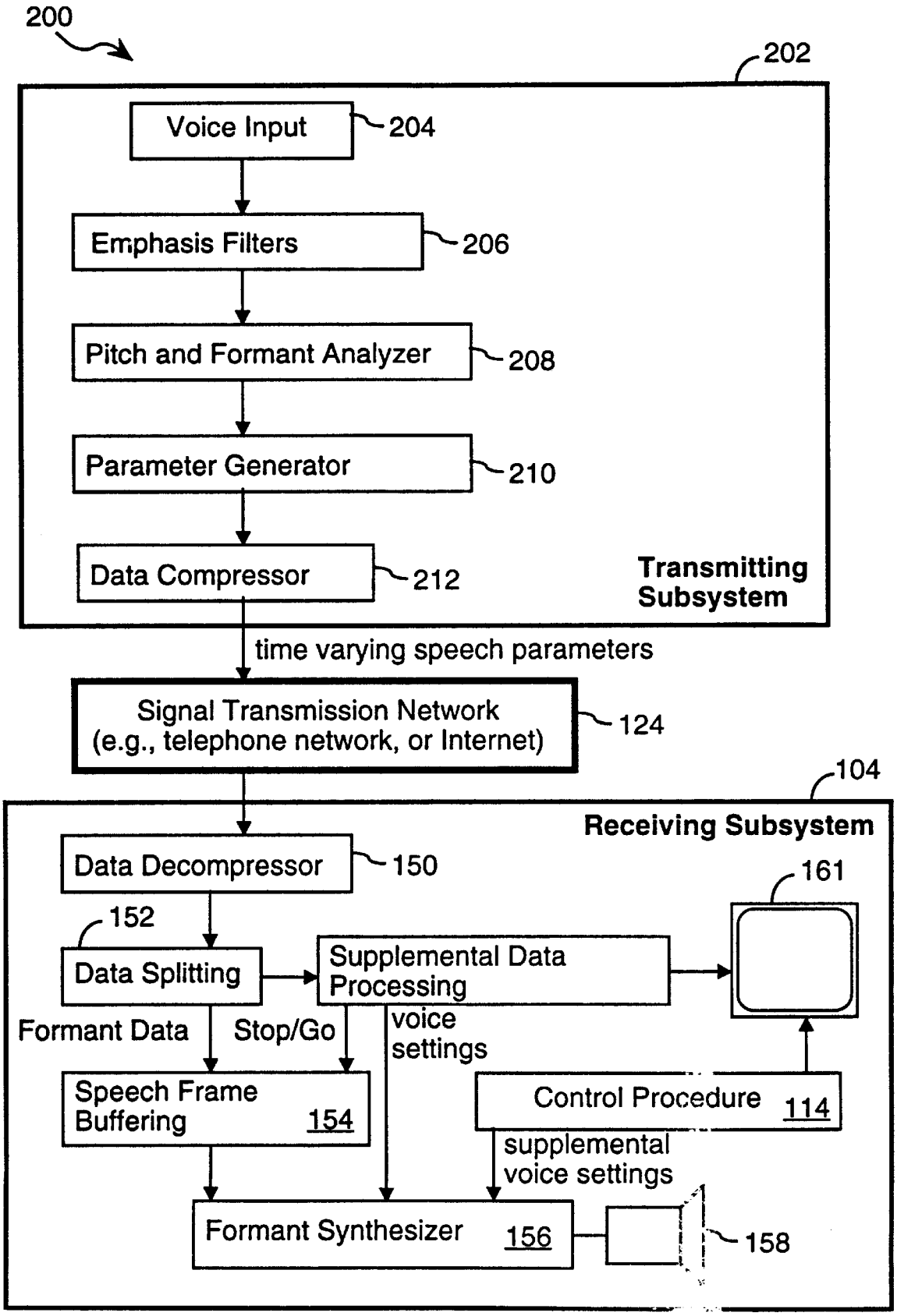
FIG. 4 is a block diagram of a second speech signal distribution system, that is compatible with the receiving subsystems of the system in FIG. 1, in accordance with a preferred embodiment of the present invention.

FIG. 4 shows a system 200 in which the receiving subsystem 104 is the same as shown in FIGS. 1 and 3, but uses a different transmitting subsystem 202 that accepts voice input 204 and outputs a formant data stream similar to that produced by the transmitting subsystem 102 described above with reference to FIGS. 1 and 2. The voice input is processed by emphasis filters 206, a pitch and formant analyzer 208, a parameter generator 210 for generating a stream of formant parameters, and a data compressor 212.

The transmitting subsystem 202 may optionally include a speech recognition subsystem (not shown) for generating text corresponding to the voice input, as well as supplemental procedures for generating lip position data corresponding to the phonemes in the generated text, voice setting data representing various characteristics of the voice input, and boundary data to represent sentence or other linguistic boundaries in the voice input, as well as a data insertion procedure for inserting the text, lip position data, voice setting data and boundary data into the data stream processed by the data compressor 212.

Thus, as shown, the receiving subsystems 104 are compatible with transmitting subsystems 102 that convert text into a stream of speech parameters as well as transmitting subsystems 202 that convert voice input into a stream of speech parameters.

Alternate Embodiments

The linguistic analyzer and formant parameter generator 128, in addition to generating lip position data, may also determine through linguistic processing indications of surprise, emphasis, mood, and the like, and may generate corresponding supplemental data indicating associated facial expressions, mood and gestures. The receiving subsystem's animation program 164 may be enhanced to generate animated pictures that show the facial expressions, mood and gestures represented by this supplemental data. Furthermore, in some receiving subsystems 104, the animation program 164 may be used to drive devices other than a computer monitor, such as an LCD screen or other media suitable for displaying animated figures or images.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A speech signal distribution system comprising:

a text to speech parameter converter for converting text containing sentences into a data stream, said data stream including a stream of speech signal parameters representing spoken text and lacking phrase-level and sentence-level prosodic content, being suitable for driving an audio signal generator that converts said stream of parameters into an audio speech signal in accordance with a vocal tract model;

a supplemental parameter generator in communication with the text to speech parameter converter, such generator inserting into said data stream additional data, representative of linguistic boundaries, that indicate which parameters in said stream of parameters are associated with predefined boundaries of at least one of phrases and sentences in said text; and a transmitter for transmitting said, data stream.

2. The speech signal distribution system of claim 1, further including:

a receiving subsystem that receives said transmitted data stream, said receiving subsystem including:

said audio signal generator that converts said stream of parameters into an audio speech signal in accordance with said vocal tract model; and a sentence level data stream buffer for storing said received data stream in a buffer until said received data stream includes boundary data indicating a sentence boundary, and for then enabling said stored data stream up to said sentence boundary to be processed by said audio signal generator.

3. The speech signal distribution system of claim 1, said text including a sequence of words;

said supplemental parameter generator further inserting into said data stream text data representing at least a subset of the words in said text, wherein said text data is inserted at positions in said data stream coinciding with the corresponding parameters in said stream of parameters.

4. The speech signal distribution system of claim 3, further including a receiving subsystem that receives said transmitted data stream, said receiving subsystem including:

said audio signal generator that converts said stream of parameters into an audio speech signal in accordance with said vocal tract model; and a video signal generator for generating a video image that includes images corresponding to at least a subset of said text data in said received data stream.

5. The speech signal distribution system of claim 1, said supplemental parameter generator further inserting into said data stream voice setting data representing parameters for controlling audio speech generation from said stream of parameters by said audio signal generator.

6. The speech signal distribution system of claim 5 further including a receiving subsystem that receives said transmitted data stream, said receiving subsystem including:

said audio signal generator that converts said stream of parameters into an audio speech signal in accordance with said vocal tract model and in accordance with said voice setting data in said received data stream.

7. A speech signal distribution system, comprising:

a text to speech parameter converter for converting text containing sentences into a data stream, said data stream including a stream of parameters suitable for driving an audio signal generator that converts said stream of parameters into an audio speech signal in accordance with a vocal tract model; said text including a sequence of words;

a supplemental parameter generator for inserting into said data stream text data representing at least a subset of the words in said text, wherein said text data is inserted at positions in said data stream coinciding with the corresponding parameters in said stream of parameters; and a transmitter for transmitting said data stream.

8. The speech signal distribution system of claim 7, further including a receiving subsystem that receives said transmitted data stream, said receiving subsystem including:

said audio signal generator that converts said stream of parameters into an audio speech signal in accordance with said vocal tract model; and a video signal generator for generating a video image that includes images corresponding to at least a subset of said text data in said received data stream.

9. A speech signal distribution method comprising the steps of:

a. converting text containing sentences into a data stream, said data stream including a stream of speech signal parameters representing spoken text and lacking phrase-level and sentence-level prosodic content, being suitable for driving an audio signal generator that converts said stream of parameters into an audio speech signal in accordance with a vocal tract model;

b. insertng into said data stream, established by step (a), additional data, representative of linguistic boundaries, that indicate which parameters in said stream of parameters are associated with predefined boundaries of at least one of phrases and sentences in said text; and c. transmitting said data stream.

10. The speech signal distribution method of claim 9, further including at a receiving subsystem:

receiving said transmitted data stream;

converting said stream of parameters into an audio speech signal in accordance with said vocal tract model; and storing said received data stream in a buffer until said received data stream includes boundary data indicating a predefined linguistic boundary, and for then enabling said stored data stream up to said predefined linguistic boundary to be converted into an audio signal.

11. The speech signal distribution method of claim 9, said text including a sequence of words;

said inserting step including inserting into said data stream text data representing at least a subset of the words in said text, wherein said text data is inserted at positions in said data stream coinciding with the corresponding parameters in said stream of parameters.

12. The speech signal distribution method of claim 11, further including at a receiving subsystem:

receiving said transmitted data stream;

converting said stream of parameters into an audio speech signal in accordance with said vocal tract model; and generating a video image that includes images corresponding to at least a subset of said text data in said received data stream.

13. The speech signal distribution method of claim 9, said inserting step including inserting into said data stream voice setting data representing parameters for controlling audio speech generation from said stream of parameters.

14. The speech signal distribution method of claim 13, further including at a receiving subsystem:

receiving said transmitted data stream;

converting said stream of parameters into an audio speech signal in accordance with said vocal tract model; and controlling the conversion of said audio speech signal in accordance with said voice setting data in said received data stream.

15. A speech signal distribution method, comprising the steps of:

converting text containing sentences into a data stream, said data stream including a stream of parameters suitable for driving an audio signal generator that converts said stream of parameters into an audio speech signal in accordance with a vocal tract model; said text including a sequence of words;

inserting into said data stream text data representing at least a subset of the words in said text, wherein said text data is inserted at positions in said data stream coinciding with the corresponding parameters in said stream of parameters; and transmitting said data stream.

16. The speech signal distribution method of claim 15, further including at a receiving subsystem:

receiving said transmitted data stream;

converting said stream of parameters into an audio speech signal in accordance with said vocal tract model; and generating a video image that includes images corresponding to at least a subset of said text data in said received data stream.

17. A speech signal distribution system comprising:

a receiving subsystem that receives a data stream transmitted by a remotely located subsystem, said received data stream including (i) a stream of speech signal parameters representing spoken text and lacking phrase-level and sentence-level prosodic content, and (ii) additional data, representative of linguistic boundaries, that indicate which parameters in said stream of speech signal parameters are associated with predefined boundaries of at least one of phrases and sentences in said text;

said receiving subsystem including:

an audio signal generator that converts said stream of speech signal parameters into an audio speech signal in accordance with a vocal tract model; and a data stream buffer for storing said received data stream in a buffer until said received data stream includes boundary data indicating a linguistic boundary of at least one of phrases and sentences, and for then enabling said stored data stream up to said linguistic boundary to be processed by said audio signal generator.

18. The speech generation system of claim 17, said received data stream further including text data representing at least a subset of the words in said text, wherein said text data is inserted at positions in said data stream coinciding with the corresponding parameters in said stream of speech signal parameters;

said receiving subsystem further including a video signal generator for generating a video image that includes images corresponding to at least a subset of said text data in said received data stream.

19. The speech generation system of claim 17, said received data stream further including voice setting data representing parameters for controlling audio speech generation from said stream of speech signal parameters;

said audio signal generator converting said stream of parameters into an audio speech signal in accordance with said vocal tract model and in accordance with said voice setting data in said received data stream.

20. The speech distribution system of claim 1, said supplemental parameter generator further inserting into said data stream supplemental linguistic processing data representing indications of at least one of surprise, emphasis and mood, said supplemental data representing parameters for controlling audio speech generation from said stream of parameters by said audio signal generator.

21. The speech distribution system of claim 20, further including a receiving subsystem that receives said transmitted data stream, said receiving subsystem including:

said audio signal generator that converts said stream of parameters into an audio speech signal in accordance with said vocal tract model and in accordance with said supplemental linguistic processing data representing indications of at least one of surprise, emphasis and mood in said received data stream.

22. The speech distribution system of claim 20, said supplemental parameter generator further inserting into said data stream supplemental linguistic processing data representing indications of at least one of surprise, emphasis and mood, said supplemental data representing parameters for controlling video image generation from said stream of parameters by a video image generator.

23. The speech distribution system of claim 22, further including a receiving subsystem that receives said transmitted data stream, said receiving subsystem including:

said video image generator that converts said stream of parameters into a video image signal in accordance with said supplemental linguistic processing data representing indications of at least one of surprise, emphasis and mood in said received data stream.

* * * * *